US007618929B2

(12) United States Patent
Tipton et al.

(10) Patent No.: US 7,618,929 B2
(45) Date of Patent: Nov. 17, 2009

(54) SECONDARY AND TERTIARY AMINES AS FRICTION MODIFIERS FOR AUTOMATIC TRANSMISSION FLUIDS

(75) Inventors: Craig D. Tipton, Perry, OH (US); Mark R. Baker, Lyndhurst, OH (US); Shreyasi Lahiri, Mentor, OH (US); William D. Abraham, Concord Township, OH (US); Richard J. Vickerman, Stow, OH (US); Suzanne M. Patterson, Seven Hills, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 660 days.

(21) Appl. No.: 11/279,481

(22) Filed: Apr. 12, 2006

(65) Prior Publication Data

US 2006/0172899 A1 Aug. 3, 2006

Related U.S. Application Data

(63) Continuation-in-part of application No. 10/968,417, filed on Oct. 19, 2004, now Pat. No. 7,439,213.

(51) Int. Cl.
*C10M 133/08* (2006.01)

(52) U.S. Cl. ..... 508/562; 508/545; 508/287

(58) Field of Classification Search ..... 508/562, 508/545, 287

See application file for complete search history.

(56) References Cited

U.S. PATENT DOCUMENTS

| | | | | |
|---|---|---|---|---|
| 1,888,023 | A | 11/1932 | Adams | |
| 3,238,130 | A | 3/1966 | Matson | |
| 3,932,290 | A | 1/1976 | Koch et al. | |
| 3,933,659 | A | 1/1976 | Lyle et al. | |
| 4,886,612 | A | 12/1989 | Higaki et al. | |
| 4,915,857 | A * | 4/1990 | Emert et al. | 508/287 |
| 5,750,476 | A | 5/1998 | Nibert et al. | |
| 5,817,605 | A | 10/1998 | Papay | 508/187 |
| 5,858,929 | A | 1/1999 | Sumiejski et al. | |
| 2002/0151441 | A1 * | 10/2002 | Srinivasan et al. | 508/188 |
| 2003/0134758 | A1 * | 7/2003 | Bovington et al. | 508/525 |
| 2005/0192185 | A1 * | 9/2005 | Saathoff et al. | 508/291 |

FOREIGN PATENT DOCUMENTS

| | | |
|---|---|---|
| DD | 216252 | 12/1984 |
| EP | 0 919 605 A1 | 6/1999 |
| GB | 1 222 169 | 2/1971 |
| WO | 9712949 | 4/1997 |
| WO | 04007652 | 1/2004 |

OTHER PUBLICATIONS

U.S. Appl. No. 10/968,417, filed Oct. 19, 2004, Tipton et al.
Search Report of international application PCT/US2006/066371, Oct. 2007.
ISA Written Opinion of international application PCT/US2006/066371, Oct. 2007.

* cited by examiner

*Primary Examiner*—Glenn Caldarola
*Assistant Examiner*—Jim Goloboy
(74) *Attorney, Agent, or Firm*—David M. Shold; Christopher D. Hilker

(57) ABSTRACT

A composition of a major amount of an oil of lubricating viscosity; a secondary or tertiary amine being represented by the formula $R^1R^2NR^3$ wherein $R^1$ and $R^2$ are alkyl groups of at least 6 carbon atoms and $R^3$ is hydrogen, a hydrocarbyl group, a hydroxyl-containing alkyl group, or an amine-containing alkyl group; and a dispersant, provides high static coefficients of friction and a durable positive slope during oxidative and mechanical stressing, particularly as a friction component of an automatic transmission.

15 Claims, No Drawings

SECONDARY AND TERTIARY AMINES AS FRICTION MODIFIERS FOR AUTOMATIC TRANSMISSION FLUIDS

This is a continuation-in-part of copending U.S. application Ser. No. 10/968,417, filed Oct. 19, 2004.

BACKGROUND OF THE INVENTION

The present invention relates to the field of additives for fluids such as automatic transmission fluids, traction fluids, fluids for continuously variable transmission fluids (CVTs), dual clutch automatic transmission fluids, farm tractor fluids, and engine lubricants.

In the automatic transmission marketplace, where there is rapid engineering change driven by the desire to reduce weight and increase transmission capacity, there is a desire for automatic transmission fluids that exhibit a high static coefficient of friction for improved clutch a holding capacity. At the same time, there is a desire to improve the retention of positive slope characteristics in the μt/V (coefficient of friction vs. sliding speed) curve. There are newer tests in the marketplace which are used to define these characteristics. The static torque can be measured in tests such as the Toyota SAE#2 friction test procedure and the retention of positive slope can be measured by procedures like the JASO LVFA (Japan Automotive Standards Organization, Low Velocity Friction Apparatus) in which the slope of the μL/V curve is periodically measured during oxidative and mechanical aging.

There are patents, for example, U.S. Pat. No. 5,750,476, where a type of friction modifier technology used to achieve this performance is described. The combined requirements of high static coefficient of friction and durable positive slope are often incompatible with traditional ATF friction modifier technology which is extremely well described in the patent literature. Many of the commonly used friction modifiers result in a low static coefficient of friction and are not durable enough on positive slope to be of sufficient use. Additional patent literature describing technology for retaining positive mu/v or anti-shudder characteristics include U.S. Pat. No. 5,858,929. These may employ metal detergents and combinations of friction modifiers.

PCT Publication WO04/007652, Adams et al, Jan. 22, 2004, discloses a fluid composition of (a) a friction modifier derived from the reaction of a carboxylic acid with an amino alcohol, the friction modifier containing at least two hydrocarbyl groups, and (b) a dispersant, which provides good friction properties in an automatic transmission.

U.S. Pat. No. 4,886,612 discloses a lubricating oil comprising at least one of various products, which can be various imidazolines or an oxazoline of the structure

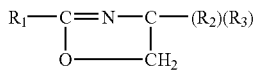

where $R_2$ and $R_3$ each represent $CH_2OCOR_1$, $CH_2OH$ or H, prepared by the condensation a carboxylic acid (or a reactive equivalent thereof) with an amino alcohol; for example, the condensation of two moles of isostearic acid with one mole of tris-hydroxymethylaminomethane (THAM).

The present invention solves the problem of developing new and relatively simple and inexpensive friction modifiers to obtain high static coefficients of friction and maintain a durable positive slope during oxidative and mechanical stressing of the friction system, particularly for use in an automatic transmission. This is accomplished by the use of a friction modifier which comprises a secondary or tertiary amine having at least two alkyl groups of at least 6 carbon atoms, as further described below.

SUMMARY OF THE INVENTION

The present invention provides a composition suitable for lubricating a transmission, comprising:

(a) a major amount of an oil of lubricating viscosity;

(b) a secondary or tertiary amine being represented by the formula $$R^1R^2NR^3$$

wherein $R^1$ and $R^2$ are each independently an alkyl group of at least 6 carbon atoms and $R^3$ is a hydroxyl-containing alkyl group, a hydroxyl-containing alkoxyalkyl group, an amine-containing alkyl group, a hydrocarbyl group, or hydrogen, provided that when $R^3$ is H, then at least one of $R^1$ and $R^2$ is an alkyl group of 8 to 16 carbon atoms; and (c) a dispersant.

The present invention further provides a method for lubricating a transmission, comprising supplying thereto the above composition.

The present invention further provides a concentrate suitable for dilution with oil of lubricating viscosity to prepare a lubricant for a transmission, comprising (a) a concentrate-forming amount of an oil of lubricating viscosity; (b) a secondary or tertiary amine as described above; and (c) a dispersant.

DETAILED DESCRIPTION OF THE INVENTION

Various preferred features and embodiments will be described below by way of non-limiting illustration.

One component of the present invention is an oil of lubricating viscosity, which can be present in a major amount, for a lubricant composition, or in a concentrate forming amount, for a concentrate. Suitable oils include natural and synthetic lubricating oils and mixtures thereof. In a fully formulated lubricant, the oil of lubricating viscosity is generally present in a major amount (i.e. an amount greater than 50 percent by weight). Typically, the oil of lubricating viscosity is present in an amount of 75 to 95 percent by weight, and often greater than 80 percent by weight of the composition.

Natural oils useful in making the inventive lubricants and functional fluids include animal oils and vegetable oils as well as mineral lubricating oils such as liquid petroleum oils and solvent-treated or acid-treated mineral lubricating oils of the paraffinic, naphthenic or mixed paraffinic/-naphthenic types which may be further refined by hydrocracking and hydrofinishing processes.

Synthetic lubricating oils include hydrocarbon oils and halo-substituted hydrocarbon oils such as polymerized and interpolymerized olefins, also known as polyalphaolefins; polyphenyls; alkylated diphenyl ethers; alkyl- or dialkylbenzenes; and alkylated diphenyl sulfides; and the derivatives, analogs and homologues thereof. Also included are alkylene oxide polymers and interpolymers and derivatives thereof, in which the terminal hydroxyl groups may have been modified by esterification or etherification. Also included are esters of dicarboxylic acids with a variety of alcohols, or esters made from C5 to C12 monocarboxylic acids and polyols or polyol ethers. Other synthetic oils include silicon-based oils, liquid esters of phosphorus-containing acids, and polymeric tetrahydrofurans.

Unrefined, refined and rerefined oils, either natural or synthetic, can be used in the lubricants of the present invention. Unrefined oils are those obtained directly from a natural or synthetic source without further purification treatment. Refined oils have been further treated in one or more purification steps to improve one or more properties. They can, for example, be hydrogenated, resulting in oils of improved stability against oxidation.

In one embodiment, the oil of lubricating viscosity is an API Group II, Group III, Group IV, or Group V oil, including a synthetic oil, or mixtures thereof. These are classifications established by the API Base Oil Interchangeability Guidelines. Both Group II and Group III oils contain <0.03 percent sulfur and >99 percent saturates. Group II oils have a viscosity index of 80 to 120, and Group III oils have a viscosity index >120. Polyalphaolefins are categorized as Group IV. The oil can also be an oil derived from hydroisomerization of wax such as slack wax or a Fischer-Tropsch synthesized wax. Group V is encompasses "all others" (except for Group I, which contains >0.03% S and/or <90% saturates and has a viscosity index of 80 to 120).

In a preferred embodiment, at least 50% by weight of the oil of lubricating viscosity is a polyalphaolefin (PAO). Typically, the polyalphaolefins are derived from monomers having from 4 to 30, or from 4 to 20, or from 6 to 16 carbon atoms. Examples of useful PAOs include those derived from 1-decene. These PAOs may have a viscosity of 1.5 to 150 $mm^2/s$ (cSt) at 100° C. PAOs are typically hydrogenated materials.

The oils of the present invention can encompass oils of a single viscosity range or a mixture of high viscosity and low viscosity range oils. In a preferred embodiment, the oil exhibits a 100° C. kinematic viscosity of 1 or 2 to 8 or 10 $mm^2/sec$ (cSt). The overall lubricant composition is preferably formulated using oil and other components such that the viscosity at 100° C. is 1 or 1.5 to 10 or 15 or 20 $mm^2/sec$ and the Brookfield viscosity (ASTM-D-2983) at −40° C. is less than 20 or 15 Pa-s (20,000 cP or 15,000 cP), preferably less than 10 Pa-s, even 5 or less.

Component (b) is a secondary or tertiary amine, which can serve as a friction modifier. The amine will contain at least two substituent hydrocarbyl groups, for example, alkyl groups. The amine is represented by the formula $$R^1R^2NR^3$$

wherein $R^1$ and $R^2$ are each independently an alkyl group of at least 6 carbon atoms (e.g. 8 to 20 carbon atoms or 10 to 18 or 12 to 16) and $R^3$ is a hydroxyl-containing alkyl group, a hydroxyl-containing alkoxyalkyl group, an amine-containing alkyl group, a hydrocarbyl group, or hydrogen, provided that when $R^3$ is H, then at least one of $R^1$ and $R^2$ is an alkyl group of 8 to 16 carbon atoms such as, for instance, 10 to 16 carbon atoms or 12 to 14 carbon atoms. In certain embodiments both of $R^1$ and $R^2$ are alkyl groups of 8 to 16, or 10 to 16, or 12 to 14 carbon atoms. A commercial example of such an amine is Armeen 2C™, which is a secondary amine where the two alkyl groups are believed to be predominately $C_{12}$ to $C_{14}$.

In one embodiment the amine comprises di-cocoalkyl amine or homologous amines. Di-cocoalkyl amine (or di-cocoamine) is a secondary amine in which two of the R groups in the above formula are predominantly $C_{12}$ groups, derived from coconut oil and the remaining R group is H. In another embodiment the amine may be Armeen HTL8™, which is believed to be a secondary amine with mixed alkyl groups comprising 2-ethylhexyl groups (C8) and hydrogenated tallow groups (largely C16-18).

In another embodiment, $R^3$ in the above structure is $—CH_2—CHOH—R^4$, where $R^4$ is hydrogen or an alkyl group, e.g., a methyl group or an alkyl group of 1 to 26 carbon atoms, or 6 to 20 carbon atoms, or 12 to 18 carbon atoms, or 14 to 16 carbon atoms, or 14 carbon atoms. Such materials can be prepared by reaction of a secondary amine such as di-cocoalkylamine with an epoxide, such as propylene oxide (in the case where $R^4$ is methyl). The resulting products can thus, more specifically, be represented by the structure $$R^1R^2N—CH_2—CHOH—CH_3$$

where $R^1$ and $R^2$ are, as described above, independently alkyl groups of 8 to 20 carbon atoms. The reaction of the dialkyl amine and the epoxide can be effected by reaction under pressure in the presence of a basic catalyst. In another embodiment, $R^3$ is an aminopropyl groups such as $—CH_2—CH_2—CH_2—NH_2$, and the resulting product can be prepared by reaction of a secondary amine such as dicocoalkyl amine with acrylonitrile followed by a reduction.

In another embodiment, $R^3$ can be a polyol-containing alkyl group (that is, a group containing 2 or more hydroxy groups) or a group containing one or more hydroxy groups and one or more amine groups. For instance, $R^3$ may be $—CH_2—CHOH—CH_2OH$ or a homologue thereof, containing, for example, 3 to 8 carbon atoms or 3 to 6 carbon atoms or 3 to 4 carbon atoms, and 2, 3, 4 or more hydroxy groups (normally no more than one hydroxy group per carbon atom). A typical resulting product may thus be represented by $$R^1R^2N—CH_2—CHOH—CH_2OH$$

or homologues thereof, where $R^1$ and $R^2$ are, as described above, independently alkyl groups of 8 to 20 carbon atoms. Such products may be obtained by the reaction of a dialkyl amine with an epoxide or chlorohydroxy compound. In particular, reaction of a secondary amine with glycidol (2,3-epoxy-1-propanol) or "chloroglycerine" (that is, 3-chloropropane-1,2-diol) may be effective under conditions as described above. Such materials based on the reaction of dicocoamine with one or more moles of glycidol or chloroglycerine are particularly useful in providing friction-modifying performance. If reaction is with multiple moles of glycidol or chloroglycerine, or other epoxyalkanols or chlorodiols, a dimeric or oligomeric ether-containing group, that is, a hydroxyl-substituted alkoxyalkyl group, may result.

In certain embodiments, thus, the amine may be a tertiary amine, that is, in which $R^3$ is other than hydrogen. If all three groups $R^1$, $R^2$, and $R^3$ are alkyl groups, then $R^3$ may also be an alkyl group of at least 6 carbon atoms (e.g., 8 to 20) carbon atoms or 10 to 18 or 12 to 16).

The amount of component (b) in the compositions of the present invention is generally an amount suitable to reduce or inhibit shudder in an automatic transmission, that is, a performance defect observed during shirting when the friction characteristics of the transmission fluid are inadequately balanced. The effective amount can be 0.01 to 10.0 percent by weight of the finished fluid formulation. Alternative amounts include 0.02 percent to 5 percent, or 0.1 percent to 3 percent, or 0.1 to 2 percent, or 0.5 to 1.5 percent. In a concentrate, the amounts will be proportionately higher.

Component (c) is a dispersant. It may be described as "other than a species of (b)," in the event that some of the friction modifiers of (b) may exhibit some dispersant characteristics. Examples of "carboxylic dispersants" are described in many U.S. Patents including the following: U.S. Pat. Nos. 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, Re 26,433, and 6,165,235.

Succinimide dispersants, a species of carboxylic dispersants, are prepared by the reaction of a hydrocarbyl-substituted succinic anhydride (or reactive equivalent thereof, such as an acid, acid halide, or ester) with an amine, as described above. The hydrocarbyl substituent group generally contains an average of at least 8, or 20, or 30, or 35 up to 350, or to 200, or to 100 carbon atoms. In one embodiment, the hydrocarbyl group is derived from a polyalkene. Such a polyalkene can be characterized by an $\overline{M}_n$ (number average molecular weight) of at least 500. Generally, the polyalkene is characterized by an $\overline{M}_n$ of 500, Or 700, or 800, or 900 up to 5000, or to 2500, or to 2000, or to 1500. In another embodiment $\overline{M}_n$ varies from 500, or 700, or 800, to 1200 or 1300. In one embodiment the polydispersity ($\overline{M}_w/\overline{M}_n$) is at least 1.5.

The polyalkenes include homopolymers and inter-polymers of polymerizable olefin monomers of 2 to 16 or to 6, or to 4 carbon atoms. The olefins may be monoolefins such as ethylene, propylene, 1-butene, isobutene, and 1-octene; or a polyolefinic monomer, such as diolefinic monomer, such 1,3-butadiene and isoprene. In one embodiment, the inter-polymer is a homopolymer. An example of a polymer is a polybutene. In one instance about 50% or the polybutene is derived from isobutylene. The polyalkenes can be prepared by conventional procedures.

In one embodiment, the succinic acylating agents are prepared by reacting a polyalkene with an excess of maleic anhydride to provide substituted succinic acylating agents wherein the number of succinic groups for each equivalent weight of substituent group is at least 1.3, e.g., 1.5, or 1.7, or 1.8. The maximum number of succinic groups per substituent group generally will not exceed 4.5, or 2.5, or 2.1, or 2.0. The preparation and use of substituted succinic acylating agents wherein the substituent is derived from such polyolefins are described in U.S. Pat. No. 4,234,435.

The substituted succinic acylating agent can be reacted with an amine, including those amines described above and heavy amine products known as amine still bottoms. The amount of amine reacted with the acylating agent is typically an amount to provide a mole ratio of CO:N of 1:2 to 1:0.75. If the amine is a primary amine, complete condensation to the imide can occur. Varying amounts of amide product, such as the amidic acid, may also be present. If the reaction is, rather, with an alcohol, the resulting dispersant will be an ester dispersant. If both amine and alcohol functionality are present, whether in separate molecules or in the same molecule (as in the above-described condensed amines), mixtures of amide, ester, and possibly imide functionality can be present. These are the so-called ester-amide dispersants.

"Amine dispersants" are reaction products of relatively high molecular weight aliphatic or alicyclic halides and amines, preferably polyalkylene polyamines. Examples thereof are described in the following U.S. Patents: U.S. Pat. Nos. 3,275,554, 3,438,757, 3,454,555, and 3,565,804.

"Mannich dispersants" are the reaction products of alkyl phenols in which the alkyl group contains at least 30 carbon atoms with aldehydes (especially formaldehyde) and amines (especially polyalkylene polyamines). The materials described in the following U.S. Patents are illustrative: U.S. Pat. Nos. 3,036,003, 3,236,770, 3,414,347, 3,448,047, 3,461,172, 3,539,633, 3,586,629, 3,591,598, 3,634,515, 3,725,480, 3,726,882, and 3,980,569.

Post-treated dispersants are also part of the present invention. They are generally obtained by reacting at carboxylic, amine or Mannich dispersants with reagents such as urea, thiourea, carbon disulfide, aldehlydes, ketones, carboxylic acids, hydrocarbon-substituted succinic anhydrides, nitrites, epoxides, boron compounds such as boric acid (to give "borated dispersants"), phosphorus compounds such as phosphorus acids or anhydrides, or 2,5-dimercaptothiadiazole (DMTD). Exemplary materials of this kind are described in the following U.S. Patents: U.S. Pat. Nos. 3,200,107, 3,282,955, 3,367,943, 3,513,093, 3,639,242, 3,649,659, 3,442,808, 3,455,832, 3,579,450, 3,600,372, 3,702,757, and 3,708,422.

Mixtures of dispersants can also be used.

The amount of component (c) in the compositions of the present invention is generally 0.3 to 10 percent by weight. In other embodiments, the amount of component (c) is 0.5 to 7 percent or 1 to 5 percent of the final blended fluid formulation. In a concentrate, the amounts will be proportionately higher.

Other components which are conventionally employed in a transmission fluid, in particular, and automatic transmission fluid (ATF) are typically also present.

One component frequently used is a viscosity modifier. Viscosity modifiers (VM) and dispersant viscosity modifiers (DVM) are well known. Examples of VMs and DVMs arc polymethacrylates, polyacrylates, polyolefins, styrene-maleic ester copolymers, and similar polymeric substances including homopolymers, copolymers and graft copolymers.

Examples of commercially available VMs, DVMs and their chemical types include the following: polyisobutylenes (Such as Indopol™ from BP Amoco or Parapol™ from Exxon Mobil); Olefin copolymers (such as Lubrizol™ 7060, 7065, and 7067 firm Lubrizol and Trilene™ CP-40 and CP-60 from Uniroyal); hydrogenated styrene-diene copolymers (Such as Shellvis™ 40 and 50, from Shell and LZ® 7341, 7351, and 7441 from Lubrizol); Styrene/maleate copolymers, which are dispersant copolymers (Such as LZ® 3702, 3715, and 3703 from Lubrizol); polymethacrylates, some of which have dispersant properties (Such as those in the Acryloid™ and Viscoplex™ series from RohMax, the TLA™ series from Texaco, and LZ 7702™ and LZ 7720™ from Lubrizol); olefin-graft-polymethacrylate polymers (such as Viscoplex™ 2-500 and 2-600 from Rohm GmbH); and hydrogenated polyisoprene star polymers (such as Shellvis™ 200 and 260, from Shell). Recent summaries of viscosity modifiers can be found in U.S. Pat. Nos. 5,157,088, 5,256,752 and 5,395,539. The VMs and/or DVMs arc incorporated into the fully-formulated compositions at a level of tip to 15% by weight. Preferred amounts are 1 to 12% or 3 to 10%.

Another component that may be used in the composition used in the present invention is a supplemental friction modifier. Friction modifiers are well known to those skilled in the art. A useful list of friction modifiers is included in U.S. Pat. No. 4,792,410. U.S. Pat. No. 5,110,488 discloses metal salts of fatty acids and especially zinc salts, useful as friction modifiers. A list of friction modifiers includes:

(i) fatty phosphites
(ii) fatty acid amides
(iii) fatty epoxides
(iv) borated fatty epoxides
(v) fatty amines other than component (b) above
(vi) glycerol esters
(vii) borated glycerol esters
(viii) alkoxylated fatty amines
(ix) borated alkoxylated fatty amines
(x) metal salts of fatty acids
(xi) sulfur ized olefins
(xii) fatty imidazolines
(xiii) condensation products of carboxylic acids and polyalkylene-polyamines (xiv) metal salts of alkyl salicylates (xv) amine salts of alkylphosphoric acids and mixtures thereof.

Representatives of each of these types of friction modifiers are known and are commercially available. For instance, (i) fatty phosphites are generally of the formula $(RO)_2PHO$. The preferred dialkyl phosphite, as shown in the preceding formula, is typically present with a minor amount of monoalkyl phosphite of the formula (RO)(HO)PHO. In these structures, the term "R" is conventionally referred to as an alkyl group. It is, of course, possible that the alkyl is actually alkenyl and thus the terms "alkyl" and "alkylated," as used herein, will embrace other than saturated alkyl groups within the phosphite. The phosphite should have sufficient hydrocarbyl groups to render the phosphite substantially oleophilic. Preferably the hydrocarbyl groups are substantially unbranched. Many suitable phosphites are available commercially and may be synthesized as described in U.S. Pat. No. 4,752,416. It is preferred that the phosphite contain 8 to 24 carbon atoms in each of R groups. Preferably, the fatty phosphite contains 12 to 22 carbon atoms in each of the fatty radicals, most preferably 16 to 20 carbon atoms. In one embodiment the fatty phosphite can be formed from oleyl groups, thus having 18 carbon atoms in each fatty radical.

(iv) Borated fatty epoxides are known from Canadian Patent No. 1,188,704. These oil-soluble boron-containing compositions are prepared by reacting, at a temperature from 80° C. to 250° C., boric acid or boron trioxide with at least one fatty epoxide having the formula

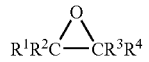

wherein each of $R^1$, $R^2$, $R^3$ and $R^4$ is hydrogen or an aliphatic radical, or any two thereof together with the epoxy carbon atom or atoms to which they are attached, form a cyclic radical. The fatty epoxide preferably contains at least 8 carbon atoms.

The borated fatty epoxides can be characterized by the method for their preparation which involves the reaction of two materials. Reagent A can be boron trioxide or any of the various forms of boric acid including metaboric acid ($HBO_2$), orthoboric acid ($H_3BO_3$) and tetraboric acid ($H_2B_4O_7$). Boric acid, and especially orthoboric acid, is preferred. Reagent B can be at least one fatty epoxide having the above formula. In the formula, each of the R groups is most often hydrogen or an aliphatic radical with at least one being a hydrocarbyl or aliphatic radical containing at least 6 carbon atoms. The molar ratio of reagent A to reagent B is generally 1:0.25 to 1:4. Ratios of 1:1 to 1:3 are preferred, with about 1:2 being an especially preferred ratio. The borated fatty epoxides can be prepared by merely blending the two reagents and heating them at temperature of 80° to 250° C., preferably 100° to 200° C., for a period of time sufficient for reaction to take place. If desired, the reaction may be effected in the presence of a substantially inert, normally liquid organic diluent. During the reaction, water is evolved and may be removed by distillation.

(iii) Non-borated fatty epoxides, corresponding to "Reagent B" above, are also useful as friction modifiers.

Borated amines are generally known from U.S. Pat. No. 4,622,158. Borated amine friction modifiers (including (ix) borated alkoxylated fatty amines) are conveniently prepared by the reaction of a boron compounds, as described above, with the corresponding amines. The amine can be a simple fatty amine or hydroxy containing tertiary amines. The borated amines can be prepared by adding the boron reactant, as described above, to an amine reactant and heating the resulting mixture at a 50° to 300° C., preferably 100° C. to 250° C. or 150° C. to 230° C., with stirring. The reaction is continued until by-product water ceases to evolve from the reaction mixture indicating completion of the reaction.

Among the amines useful in preparing the borated amines are commercial alkoxylated fatty amines known by the trademark "ETHOMEEN" and available from Alkzo Nobel. Representative examples of these ETHOMEEN™ materials is ETHOMEEN™ C/12 (bis[2-hydroxyethyl]-coco-amine); ETHOMEEN™ C/20 (polyoxyethylene[10]coco-amine); ETHOMEEN™ S/12 (bis[2-hydroxyethyl]soyamine); ETHOMEEN™ T/12 (bis[2-hydroxyethyl]-tallow-amine); ETHOMEEN™ T/15 (polyoxyethylene-[5]tallowamine); ETHOMEEN™ 0/12 (bis[2-hydroxyethyl]oleyl-amine); ETHOMEEN™ 18/12 (bis[2 hydroxyethyl]octadecylamine); and ETHOMEEN™ 18/25 (polyoxyethyl-ene[15] octadecylamine). Fatty amines and ethoxylated fatty amines are also described in U.S. Pat. No. 4,741,848.

The (viii) alkoxylated fatty amines, and (v) fatty amines themselves (such as oleylamine) are generally useful as friction modifiers in this invention. Such amines are commercially available.

Both borated and unborated fatty acid esters of glycerol can be used as friction modifiers. The (vii) borated fatty acid esters of glycerol are prepared by berating a fatty acid ester of glycerol with boric acid with removal of the water of reaction. Preferably, there is sufficient boron present such that each boron will react with from 1.5 to 2.5 hydroxyl groups present in the reaction mixture. The reaction may be carried out at a temperature in the range of 60° C. to 135° C., in the absence or presence of any suitable organic solvent such as methanol, benzene, xylenes, toluene, or oil.

(vi) Fatty acid esters of glycerol themselves can be prepared by a variety of methods well known in the art. Many of these esters, such as glycerol monooleate and glycerol tallowate, are manufactured on a commercial scale. The esters useful are oil-soluble and are preferably prepared from C8 to C22 fatty acids or mixtures thereof such as are found in natural products and as are described in greater detail below. Fatty acid monoesters of glycerol are preferred, although, mixtures of mono- and diesters may be used. For example, commercial glycerol monooleate may contain a mixture of 45% to 55% by weight monoester- and 55% to 45% diester.

Fatty acids can be used in preparing the above glycerol esters; they can also be used in preparing their (x) metal salts, (ii) amides, and (xii) imidazolines, any of which can also be used as friction modifiers. Preferred fatty acids are those containing 6 to 24 carbon atoms, preferably 8 to 18. The acids can be branched or straight-chain, saturated or unsaturated. Suitable acids include 2-ethylhexanoic, decanoic, oleic, stearic, isostearic, palmitic, myristic, palmitoleic, linoleic, lauric, and linolenic acids, and the acids from the natural products tallow, palm oil, olive oil, peanut oil, corn oil, and Neat's foot oil. A particularly preferred acid is oleic acid. Preferred metal salts include zinc and calcium salts. Examples are overbased calcium salts and basic oleic acid-zinc salt complexes which can be represented by the general formula $Zn_4Oleate_3O_1$. Preferred amides are those prepared by condensation with ammonia or with primary or secondary amines such as diethylamine and diethanolamine. Fatty imidazolines are the cyclic condensation product of an acid with a diamine or polyamine such as a polyethylenepolyamine. The imidazolines are generally represented by the structure

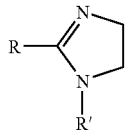

where R is an alkyl group and R' is hydrogen or a hydrocarbyl group or a Substituted hydrocarbyl group, including —$(CH_2CH_2NH)n$— groups. In a preferred embodiment the friction modifier is the condensation product of a C8 to C24 fatty acid with a polyalkylene polyamine, and in particular, the product of isostearic acid with tetraethylenepentamine. The condensation products of carboxylic acids and polyalkyleneamines (xiii) may generally be imidazolines or amides.

Sulfurized olefins (xi) are welt known commercial materials used as friction modifiers. A particularly preferred sulfurized olefin is one which is prepared in accordance with the detailed teachings of U.S. Pat. Nos. 4,957,651 and 4,959,168. Described therein is a cosulfurized mixture of 2 or more reactants selected from the group consisting of (1) at least one fatty acid ester of a polyhydric alcohol, (2) at least one fatty acid, (3) at least one olefin, and (4) at least one fatty acid ester of a monohydric alcohol.

Reactant (3), the olefin component, comprises at least one olefin. This olefin is preferably an aliphatic olefin, which usually will contain 4 to 40 carbon atoms, preferably from 8 to 36 carbon atoms. Terminal olefins, or alpha-olefins, are preferred, especially those having from 12 to 20 carbon atoms. Mixtures of these olefins are commercially available, and such mixtures are contemplated for use in this invention.

The cosulfurized mixture of two or more of the reactants, is prepared by reacting the mixture of appropriate reactants with a source of sulfur. The mixture to be sulfurized can contain 10 to 90 parts of Reactant (1), or 0.1 15 parts by weight of Reactant (2); or 10 to 90 parts, often 15 to 60 parts, more often 25 to 35 parts by weight of Reactant (3), or 10 to 90 parts by weight of reactant (4). The mixture, in the present invention, includes Reactant (3) and at least one other member of the group of reactants identified as reactants (1), (2) and (4). The sulfurization reaction generally is effected at an elevated temperature with agitation and optionally in an inert atmosphere and in the presence of an inert solvent. The sulfurizing agents useful in the process of the present invention include elemental sulfur, which is preferred, hydrogen sulfide, sulfur halide plus sodium sulfide, and a mixture of hydrogen sulfide and sulfur or sulfur dioxide. Typically often 0.5 to 3 moles of sulfur are employed per mole of olefinic bonds.

Metal salts of alkyl salicylates (xiv) include calcium and other salts of long chain (e.g. C12 to C16) alkyl-substituted salicylic acids.

Amine salts of alkylphosphoric acids (xv) include salts of oleyl and other long chain esters of phosphoric acid, with amines as described below. Useful amines in this regard are tertiary-aliphatic primary amines, sold under the tradename Primene™. The supplemental friction modifier can be used in addition to component (a). The amount of the supplemental friction modifier is generally 0.1 to 1.5 percent by weight of the lubricating composition, preferably 0.2 to 1.0 or 0.25 to 0.75 percent. In some embodiments, however, the amount of the supplemental friction modifier is present at less than 0.2 percent or less than 0.1 percent by weight, for example, 0.01 to 0.1 percent. In one embodiment the amount of, dihydroxyethyl tallowamine (commercially sold as ENT-12™) in particular is restricted to these low amounts or less.

The compositions of the present invention can also include a detergent. Detergents as used herein are metal salts of organic acids. The organic acid portion of the detergent is a sulfonate, carboxylate, phenate, salicylate. The metal portion of the detergent is an alkali or alkaline earth metal. Preferred metals are sodium, calcium, potassium and magnesium. Typically, the detergents are overbased, meaning that there is a stoichiometric excess of metal over that needed to form the neutral metal salt.

Preferred overbased organic salts are the sulfonate salts having a substantially oleophilic character and which are formed from organic materials. Organic sulfonates are well known materials in the lubricant and detergent arts. The sulfonate compound should contain on average 10 to 40 carbon atoms, preferably 12 to 36 carbon atoms and preferably 14 to 32 carbon atoms on average. Similarly, the phenates, salicylates, and carboxylates have a substantially oleophilic character.

While the present invention allows for the carbon atoms to be either aromatic or in paraffinic configuration, it is preferred that alkylated aromatics be employed. While naphthalene based materials may be employed, the aromatic of choice is the benzene moiety.

The most preferred composition is thus an overbased monosulfonated alkylated benzene, and is preferably the monoalkylated benzene. Typically, alkyl benzene fractions are obtained from still bottom sources and arc mono- or di-alkylated. It is believed, in the present invention, that the moono-alkylated aromatics are superior to the dialkylated aromatics in overall properties.

It is desired that a mixture of mono-alkylated aromatics (benzene) be utilized to obtain the mono-alkylated salt (benzene sulfonate) in the present invention. The mixtures wherein a substantial portion of the composition contains polymers of propylene as the source of the alkyl groups assist in the solubility of the salt. The use of mono-functional (e.g., mono-sulfonated) materials avoids crosslinking of the molecules with less precipitation of the salt from the lubricant.

It is preferred that the salt be "overbased." By overbasing, it is meant that a stoichiometric excess of the metal be present over that required to neutralize the anion of the salt. The excess metal from overbasing has the effect of neutralizing acids which may build up in the lubricant. A second advantage is that the overbased salt increases the dynamic coefficient of friction. Typically, the excess metal will be present over that which is required to neutralize the anion at in the ratio of up to 30:1, preferably 5:1 to 18:1 on an equivalent basis.

The amount of the overbased salt utilized in the composition is typically 0.025 to 3 weight percent on an oil free basis, preferably 0.1 to 1.0 percent. The overbased salt is usually made up in about 50% oil with a TBN range of 10-600 on an oil free basis. Borated and non-borated overbased detergents are described in U.S. Pat. Nos. 5,403,501 and 4,792,410 which are herein incorporated by reference for disclosure pertinent hereto.

The compositions of the present invention can also include at least one phosphorus acid, phosphorus acid salt, phosphorus acid ester or derivative thereof including sulfur-containing analogs in the amount of 0.002-1.0 weight percent. The phosphorus acids, salts, esters or derivatives thereof include phosphoric acid, phosphorous acid, phosphorus acid esters or salts thereof, phosphites, phosphorus-containing amides, phosphorus-containing carboxylic acids or esters, phosphorus-containing ethers, and mixtures thereof.

In one embodiment, the phosphorus acid, ester or derivative can be an organic or inorganic phosphorus acid, phosphorus acid ester, phosphorus acid salt, or derivative thereof. The phosphorus acids include the phosphoric, phosphonic, phosphinic, and thiophosphoric acids including dithiophosphoric acid as well as the monothiophosphoric, thiophosphinic and thiophosphonic acids. One group of phosphorus compounds are alkylphosphoric acid mono alkyl primary amine salts as represented by the formula

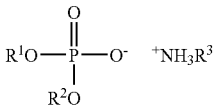

where $R^1$, $R^2$, $R^3$ are alkyl or hydrocarbyl groups or one of $R^1$ and $R^2$ can be H. The materials can be a 1:1 mixture of dialkyl and monoalkyl phosphoric acid esters. Compounds of this type are described in U.S. Pat. No. 5,354,484.

Eighty-five percent phosphoric acid is a preferred material for addition to the fully-formulated compositions and can be included at a level of 0.01-0.3 weight percent based on the weight of the composition, preferably 0.03 to 0.2 or to 0.1 percent.

Other materials can optionally be included in the compositions of the present invention, provided that they are not incompatible with the aforementioned required components or specifications. Such materials include antioxidants (that is, oxidation inhibitor-s), including hindered phenolic antioxidants, secondary aromatic amine antioxidants such as dinonyldiphenylamine as well as such well-known variants as monononyldiphenylamine and diphenylamines with other alkyl substituents such as mono- or di-ocyl, sulfurized phenolic antioxidants, oil-soluble copper compounds, phosphorus-containing antioxidants, and organic sulfides, disulfides, and polysulfides such as 2-hydroxyalkyl, alkyl thioethers or 1-t-dodecylthio-2-propanol or sulfurized 4-carbobutoxycyclohexene or other sulfurized olefins. Other optional components include seal swell compositions, such as isodecyl sulfolane or phthalate esters, which are designed to keep seals pliable. Also permissible are pour point depressants, such as alkylnaphthalenes, polymethacrylates, vinyl acetate/fumarate or /maleate copolymers, and styrene/maleate copolymers. Another material is an anti-wear agent such as zinc dialkyldithiophosphates. These optional materials are known to those skilled in the art, are generally commercially available, and are described in greater detail in published European Patent Application 761,805. Also included can be known materials such as corrosion inhibitors (e.g., tolyltriazole, dimercaptothiadiazoles), dyes, fluidizing agents, odor masking agents, and antifoam agents. Organic borate esters and organic borate salts can also be included.

The above components can be in the form of a fully-formulated lubricant or in the form of a concentrate within a smaller amount of lubricating oil. If they are present in a concentrate, their concentrations will generally be directly proportional to their concentrations in the more dilute form in the final blend.

EXAMPLES

Lubricant formulations are prepared with the following components:

| | Ex: | | | | | | | | | |
|---|---|---|---|---|---|---|---|---|---|---|
| Component | 1 | 2 | 3 | 4 | 5 | 6 | 7 | 8 | 9 | 10 |
| DISPERSANTS | | | | | | | | | | |
| Succinimide dispersant (including 40% oil) | 4.0 | 4.0 | 4.0 | 5.0 | 4.0 | 5.0 | | 4.5 | | |
| Succinimide Dispersant treated with DMTD[b] (incl. 49% oil) | 1.0 | 1.0 | 1.0 | | 1.0 | | | 0.5 | | |
| Succinimide Dispersant treated with Boron (incl. 50% oil) | | | | 0.5 | | 0.5 | 5.0 | 0.5 | | |
| Succinimide Dispersant treated with TPA[a] (including oil) | | | | | | | | | 5.0 | |
| Succinimide Dispersant treated with phosphorus and boron compounds (incl. oil) | | | | | | | | | | 5.0 |
| AMINE | | | | | | | | | | |
| Armeen ™ 2C | | | 0.5 | 0.5 | 0.5 | | | 0.8 | 0.8 | 0.8 |
| Reaction product of Armeen 2C ™ with propylene oxide (1:1 mole) | 1.25 | | | | | | | | | |
| Armeen ™ HTL8[c] | | 1.0 | | | | 1.25 | 1.25 | | | |
| INHIBITORS | | | | | | | | | | |
| 2-hydroxy-alkyl,alkyl thio-ether | 0.5 | 0.5 | | | | 0.5 | | 0.5 | 0.5 | 0.5 |

-continued

| Component | Ex: 1 | 2 | 3 | 4 | 5 | 6 | 7 | 8 | 9 | 10 |
|---|---|---|---|---|---|---|---|---|---|---|
| Dinonyldiphenyl-amine | 0.6 | 0.6 | 0.6 | 0.6 | | 0.6 | 0.8 | 0.6 | 0.6 | 0.6 |
| Hindered phenolic antioxidant | | | 0.5 | | | | | 0.5 | 0.5 | 0.5 |
| FRICTION MODIFIERS | | | | | | | | | | |
| Borate Ester | 0.2 | 0.2 | 0.2 | | | | | 0.2 | 0.2 | 0.2 |
| Diphenyl-phosphite | | | 0.25 | | | 0.25 | | | | |
| Dibutyl hydrogen phosphite | 0.11 | 0.11 | | 0.2 | | | 0.2 | 0.2 | 0.2 | 0.2 |
| Phosphoric acid | 0.1 | 0.1 | | 0.06 | | | 0.06 | 0.06 | 0.06 | 0.06 |
| OTHERS | | | | | | | | | | |
| Sulfolane seal swell agent | 0.4 | 0.4 | 0.4 | 0.35 | | 0.35 | 0.4 | 0.4 | 0.4 | 0.4 |
| Tolyltriazole | | | | 0.02 | | 0.02 | | 0.02 | 0.02 | 0.02 |
| Fatty carboxylic acid product with polyamine | | | | 0.1 | | | | 0.1 | 0.1 | 0.1 |
| Oil of lubricating viscosity[d] | | | | | balance | | | | | |

[a]Dispersant treated with terephthalic acid (TPA), optionally also treated with dimercaptothiadiazole, inorganic phosphorus acid, and/or boron
[b]DMTD = dimercaptothiadiazole
[c]secondary amine(s) having 2-ethylhexyl and hydrogenated tallow alkyl groups
[d]May include small amounts of other materials commonly present such as a viscosity index improver or an anti-foam agent.

Certain formulations are prepared and tested as follows:

Formulations are prepared in a synthetic base oil blend of 2 and 4 $mm^2/s$ (cSt, 100° C.) oils, containing commercial viscosity index improvers, dispersant(s), calcium sulfonate detergent(s), antioxidant(s), boron-containing friction modifier(s) and phosphorus containing friction modifiers. To this base formulation is added, in each case, one of the amine materials as indicated.

The static coefficient of friction for the formulations is reported in terms of μT or the stabilized static coefficient from the SAE#2 test procedure. Values of μT of at least 0.12 or at least 0.15 are desirable, e.g., 0.15 to 0.19. The average slope of friction versus speed (40° C., 24 kg load, for hours 6-11 of the test) is measured by the test procedure described in the Japanese Automobile Standard, JASO M-348-95, "Test method for friction property of automatic transmission fluids". Positive slopes over hours 6-11 are desirable, e.g., slopes greater than 0.0033 or 0.0040.

TABLE II

| Ex. | Amine compound, % | Avg. Slope | Average μT |
|---|---|---|---|
| 11 | di-Coco amine, 1.25% | +0.0055 | 0.156 |
| 12 | Armeen ™ HTL8, 1.25% | +0.0068 | 0.164 |
| 13 | Reaction product of Armeen ™ 2C + propylene oxide (1:1), 1.25% | +0.0053 | 0.167 |

The results show that the friction modifier (a), used in combination with the dispersant (b) present in the base formulation, provides a high level of static friction μT while the slope of the JASO LVFA screen test is positive.

Examples 14. Example 1 is repeated except that the amine component is the reaction product of Armeen™ 2C with glycidol (1:1 mole).

Each of the documents referred to above is incorporated herein by reference. Except in the Examples, or where otherwise explicitly indicated, all numerical quantities in this description specifying amounts or materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention can be used together with ranges or amounts for any of the other elements. As used herein, the expression "consisting essentially of" permits the inclusion of substances that do not materially affect the basic and novel characteristics of the composition under consideration.

What is claimed is:

1. A composition suitable for lubricating a transmission, comprising:

(a) a major amount of an oil of lubricating viscosity;

(b) a tertiary amine being represented by the formula $$R^1R^2NR^3$$

wherein $R^1$ and $R^2$ are each independently an alkyl group of at least 6 carbon atoms and $R^3$ is a polyol-containing alkyl group; and (c) a dispersant.

2. The composition of claim 1 wherein $R^1$ and $R^2$ are each independently alkyl groups of about 8 to about 20 carbon atoms.

3. The composition of claim 1 wherein the amount of the amine of (b) is about 0.01 to about 10 percent by weight.

4. The composition of claim 1 wherein the dispersant comprises a succinimide dispersant.

5. The composition of claim 1 wherein the amount of the dispersant is about 0.3 to about 10 percent by weight.

6. The composition of claim 1 further comprising at least one additive selected from the group consisting of detergents, antioxidants, seal swell agents, anti-wear agents, and friction modifiers.

7. The composition of claim 1 further comprising at least one additive selected from the group consisting of organic borate esters organic borate salts, organic phosphorus esters, organic phosphorus salts, inorganic phosphorus acids, and inorganic phosphorus salts.

8. The composition prepared by mixing the components of claim 1.

9. A concentrate suitable for dilution with oil of lubricating viscosity to prepare a lubricant for a transmission, comprising:

(a) a concentrate-forming amount of an oil of lubricating viscosity;

(b) a tertiary amine being represented by the formula $$R^1R^2NR^3$$

wherein $R^1$ and $R^2$ are each independently an alkyl group of at least 6 carbon atoms and $R^3$ is a polyol-containing alkyl group; and (c) a dispersant.

10. A method for lubricating a transmission, comprising supplying thereto a lubricant comprising:

(a) a major amount of an oil of lubricating viscosity; and (b) a tertiary amine being represented by the formula $$R^1R^2NR^3$$

wherein $R^1$ and $R^2$ are each independently an alkyl group of at least 6 carbon atoms and $R^3$ is a polyol-containing alkyl group.

11. The method of claim 8 wherein the transmission is an automatic transmission.

12. The composition of claim 1 wherein the amine of (b) is represented by the formula $$R^1R^2N—CH_2—CHOH—CH_2OH$$

wherein $R^1$ and $R^2$ are each independently alkyl groups of about 8 to about 20 carbon atoms.

13. The composition of claim 1 wherein the amine of (b) comprises the reaction product of di-cocoamine and one or more moles of 2,3-epoxy-1-propanol or 3-chloropropane-1,2-diol.

14. The composition of claim 9 wherein the amine of (b) is represented by the formula $$R^1R^2N—CH_2—CHOH—CH_2OH$$

wherein $R^1$ and $R^2$ are each independently alkyl groups of about 8 to about 20 carbon atoms.

15. The composition of claim 10 wherein the amine of (b) is represented by the formula $$R^1R^2N—CH_2—CHOH—CH_2OH$$

wherein $R^1$ and $R^2$ are each independently alkyl groups of about 8 to about 20 carbon atoms.

* * * * *